United States Patent [19]

Peterson

[11] Patent Number: 4,613,469

[45] Date of Patent: Sep. 23, 1986

[54] CARBURETOR FOR INTERNAL COMBUSTION ENGINES

[76] Inventor: Rex W. Peterson, 3028 Navajo La., Provo, Utah 84604

[21] Appl. No.: 573,104

[22] Filed: Jan. 23, 1984

[51] Int. Cl.[4] ..... F02M 7/04

[52] U.S. Cl. ..... 261/41 B; 261/51; 261/69 R; 261/67

[58] Field of Search ..... 261/51, 50 R, 41 B, 261/69 R, 67, 44 A

[56] References Cited

U.S. PATENT DOCUMENTS

| | | | |
|---|---|---|---|
| 1,132,314 | 3/1915 | Eiker | 261/44 A |
| 1,958,690 | 5/1934 | Ball et al. | 261/51 |
| 2,084,607 | 6/1937 | Bicknell | 261/51 |
| 2,596,429 | 5/1952 | Orr, Jr. | 261/51 |
| 2,679,835 | 6/1954 | Thorner | 261/51 |
| 3,132,191 | 5/1964 | Kennedy, Sr. | 261/50 R |
| 3,269,377 | 8/1966 | Fleming | 261/51 |
| 3,711,068 | 1/1973 | Perry | 261/41 B |
| 3,834,679 | 9/1974 | Baribean et al. | 261/51 |
| 4,132,204 | 1/1979 | Teague | 261/67 |
| 4,212,833 | 7/1980 | Harrington | 261/67 |
| 4,348,338 | 9/1982 | Martinez et al. | 261/51 |

*Primary Examiner*—Tim Miles

*Attorney, Agent, or Firm*—Thorpe, North & Western

[57] ABSTRACT

A carburetor includes a metering assembly in which the effective area of the metering orifice varies in direct proportion to movement of a vlave stem. Primary and secondary fuel circuits are controlled by the assembly in response to air flow through the carburetor to maintain an optimum fuel-to-air ratio under various load and atmospheric conditions.

7 Claims, 9 Drawing Figures

CARBURETOR FOR INTERNAL COMBUSTION ENGINES

BACKGROUND OF THE INVENTION

The present invention relates to a carburetor for internal combustion engines and more particularly to a carburetor for metering fuel in response to varying atmospheric and load conditions.

In the automotive art, carburetors of various types have been proposed for controlling delivery of fuel and air to the cylinders of an internal combustion engine. While the various devices have differed widely in construction, the basic functions of metering and atomizing the fuel and then adjusting the rate at which the fuel air mixture is made available for combustion are common. In addition, metering of fuel has typically been accomplished by a needle valve operated by a float which monitors fluid level in a fuel reservoir or bowl. The use of a needle valve in which a tapered needle is received within a circular orifice makes precise metering difficult to achieve since the area of the opening does not vary uniformly in direct proportion to movement of the needle. In addition, the float depends upon gravity and must be free to move within the bowl, so it becomes ineffective when the carburetor is tilted sharply or bounced. As a result flooding of the carburetor occurs frequently in off-road vehicles, such as motorcycles, ski mobiles, motor boats, four wheel drive vehicles, etc., when the vehicle is turned sharply or driven over rough or sharply inclined terrain.

In previously known carburetors, fuel has been metered according to a predetermined schedule, so that variations in atmospheric conditions have resulted in fluctuations in the fuel-to-air ratio. Thus, the engine is operated at other than optimum fuel-to-air ratios much of the time.

OBJECTS AND SUMMARY OF THE INVENTION

An object of the present invention is to provide a carburetor for precisely metering fuel according to needs of an engine over the full operating range of the engine.

Another object is to provide a carburetor to meter fuel appropriately in response to variations in atmospheric conditions.

A further object is to provide a carburetor for precisely metering fuel over a wide range of positions and operating conditions.

An additional object is to provide a carburetor which allows for improved engine operating efficiency.

A further object is to provide a carburetor which allows an engine to operate within allowable limits of emission pollutants with minimum pollution control equipment.

The above and other objects are realized in a specific illustrative embodiment of the present invention including a carburetor which incorporates one or more metering valves, the orifice area of each valve being varied in direct proportion to the movement of the valve stem. A primary metering valve is connected to a throttle mechanism to meter fuel for no-load acceleration and steady state engine conditions, and a secondary metering valve is responsive to movement of air through the carburetor to meter additional fuel to accommodate variation in atmospheric and engine load conditions.

BRIEF DESCRIPTION OF THE DRAWINGS

The best mode presently contemplated for carrying out the invention will be understood from the detailed description of the several embodiments illustrated in the accompanying drawings, in which.

Figures 8A, 8B, 8C:
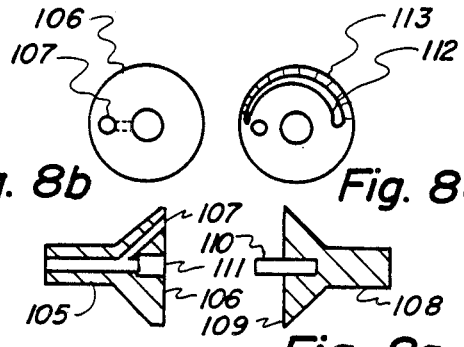
Figure 9:
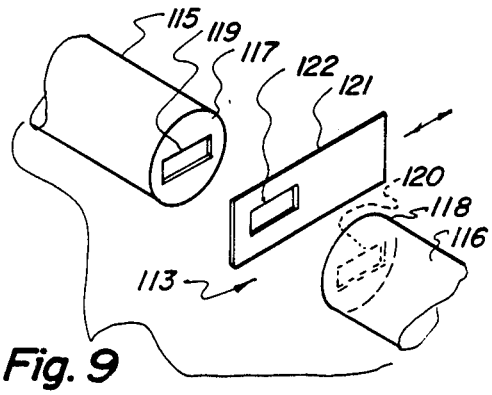

FIGS. *7a–d* are sectional views of a metering valve particularly suited for small horsepower engines such as motorcycles, snowmobiles, etc.;

FIGS. 8 *a–c* are sectional views of another metering valve for use with motorcycles or similar vehicles; and FIG. 9 is an exploded view of a flat slide valve for use with stationary engines and small air cooled engines.

DETAILED DESCRIPTION OF THE ILLUSTRATED EMBODIMENTS

Many of the disadvantages of previously known carburetors are overcome in the present invention by provision of a carburetor which meters fuel precisely and efficiently to meet the needs of an engine over its full operating range under varying atmospheric and load conditions, and which is insensitive to attitude or sudden changes in position of the engine and/or carburetor.

Figure 1:
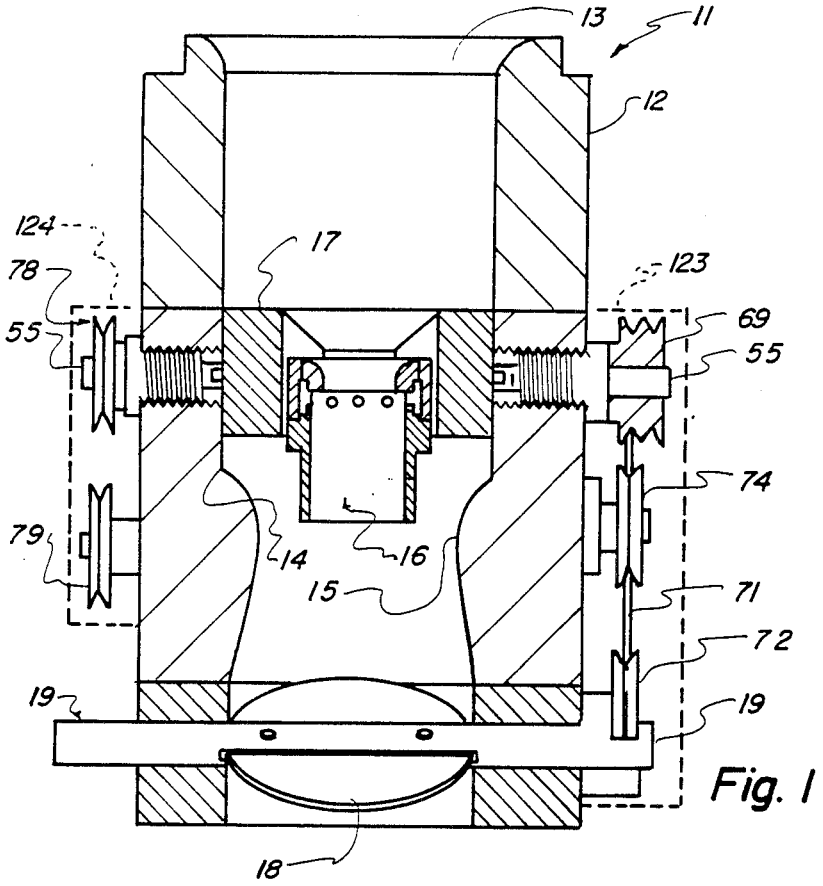
FIG. 1 is an elevation view in cross-section of a carburetor made in accordance with the principles of the present invention.
Figure 2:
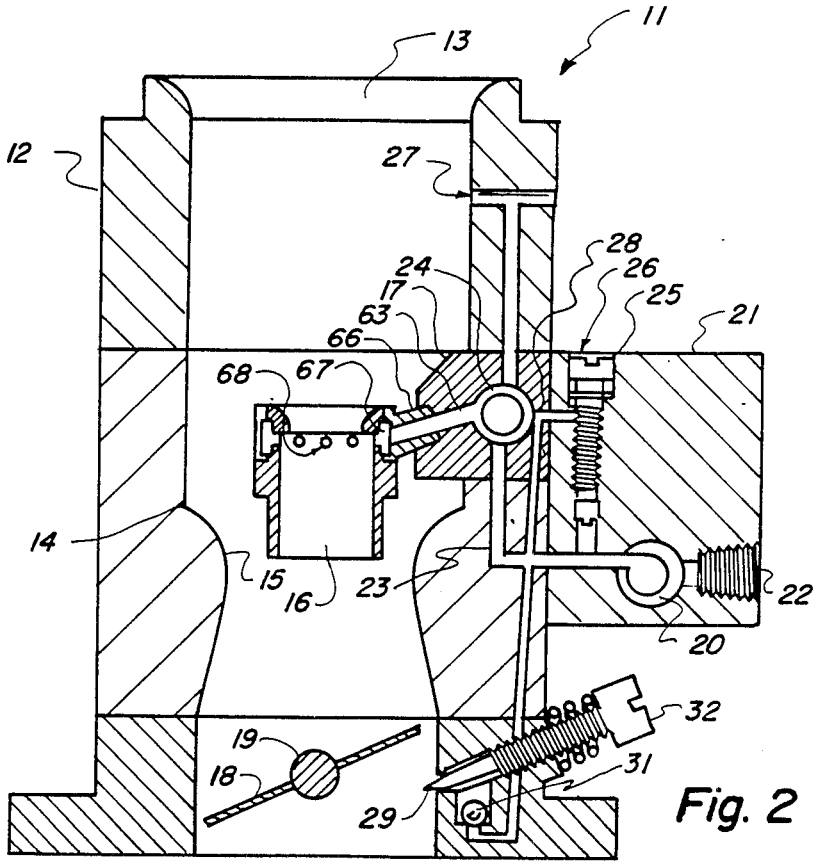
FIG. 2 is an elevation view in cross-section of the carburetor of FIG. 1 turned 90 degrees.

Referring to FIGS. 1 and 2 of the drawing, a carburetor 11 is illustrated as including an annular body 12 surrounding a generally-cylindrical air passage 13. The passage 13 extends the full length of the body 12 and includes a venturi section 14 with a relatively constricted throat 15. A fuel nozzle 16 is mounted within the passage 13 to discharge fuel into the throat 15. The nozzle is centered within the passage and is supported from an elongated block 17 which is affixed to the body 12 and houses a fuel metering assembly. A butterfly valve 18 is positioned in the passage below the throat 15 to control the rate of air flow through the passage and is mounted on a transverse shaft 19 journalled in the body 12.

As shown in FIG. 2, a block 21 is affixed to an outer surface of the body 12 and contains an attachment port 22 for receiving fuel under pressure from a fuel pump (not shown). Fuel is delivered from port 22 to a small fuel chamber 20 in the body 21. A fuel conduit 23 is formed in the block 21, body 12 and block 17 and communicates between the fuel chamber 20 and the metering assembly 24. An internally threaded bore 25 is formed in block 21 and is connected to fuel chamber 20 bypassing conduit 23. A needle valve 26 is threadedly received within the bore 25 and forms an adjustable idle control. An atomizing air conduit 27 is formed in the body 12 and extends from adjacent the inlet of air passage 13 to a portion of the metering assembly 24. A conduit 28 communicates with bore 25 and air conduit 27 and extends vertically through the body 12 to an opening 29 below the butterfly valve 18. When the engine is idling and the metering assembly 24 is closed, fuel supplied to the port 22 is transmitted through the needle valve 26 to conduit 28 where it combines with air from conduit 27. The fuel-air mixture is drawn down through conduit 28 and discharged through opening 29 into air passage 13 where it is drawn into the intake manifold (not shown). A ball check valve 31 in conduit 28 allows flow through conduit 28 when the butterfly valve is closed and blocks flow through the conduit when the butterfly valve is opened. The effective area of opening 29 is controlled by means of an adjustable needle valve 32. The rate of fuel supplied during idle is controlled by means of needle valve 26 while the rate at which the fuel-air mixture is supplied to the intake manifold is controlled by needle valve 32.

Figure 3:
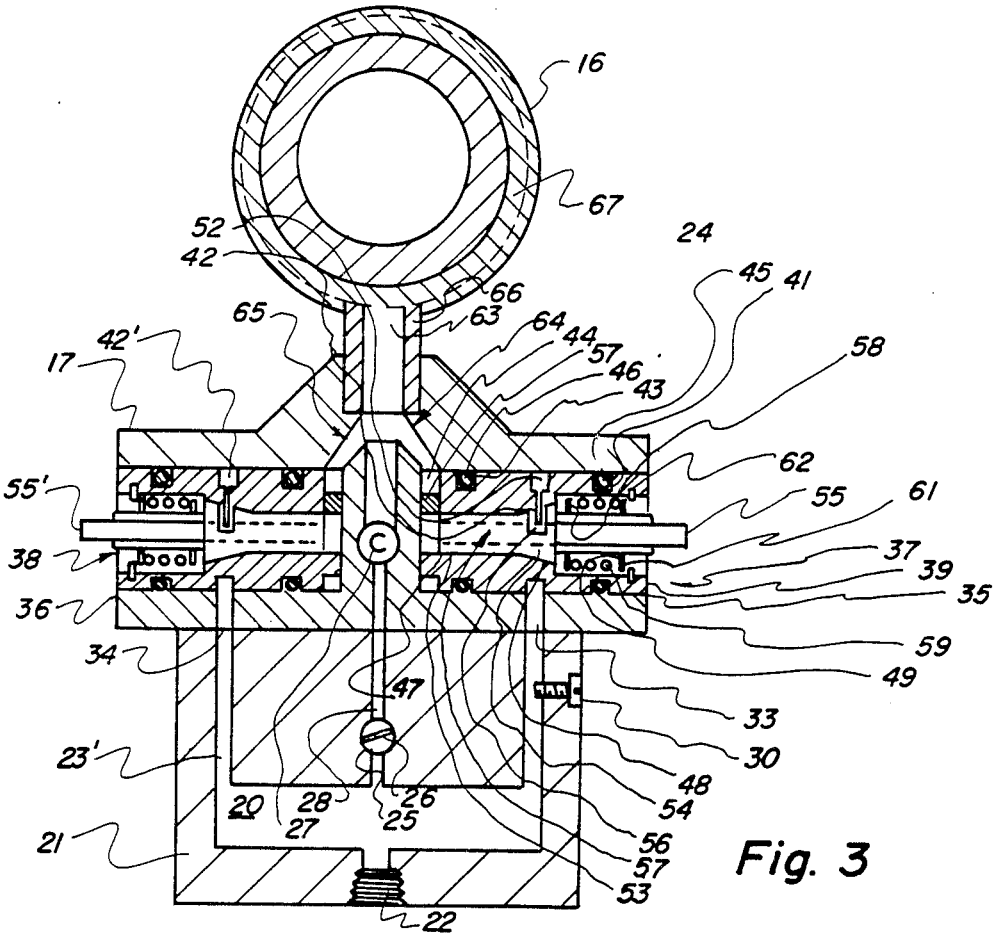
FIG. 3 is a plan view in cross-section of a metering assembly.

Referring to FIG. 3, the metering assembly 24 has a primary side and a secondary side which are independently controlled. Fuel is delivered through attachment port 22 to a fuel chamber 20 and then through conduits 23 and 23' to ports 33 and 34 in the block 17. A restriction is provided in conduit 23 by means of an externally threaded restrictor screw 30 which is threaded into block 21 to extend into and reduce the effective area of the conduit as desired. Oppositely directed blind bores 35 and 36 are formed in opposite ends of the block 17, and a metering valve 37 and 38 are positioned respectively within the bores 35 and 36. Metering valve 37 includes a sleeve 39 provided with four peripheral grooves or channels 41, 42, 43 and 44 machined, or otherwise formed, in its exterior surface. O-ring seals 45 and 46 are positioned in channels 41 and 43 to seal and retain the sleeve 39 within bore 35. The sleeve 39 is firmly positioned within the bore by a set screw (not shown). The interior surface of the sleeve has a reduced cylindrical section 47, a conical section 48 which forms a valve seat, and an enlarged cylindrical section 49. A radial hole 51 extends between the bottom of the reduced cylindrical section 47 and the peripheral channel 44 while a narrow slot 52 is machined in the bottom of the channel 42 to connect approximately 180° of the channel with the interior of the conical section 48. A valve stem includes a cylindrical guide 53 joined at one end to a conical plug 54 and a shaft 55. A wide slot 56 is formed in the plug 54 to extend over approximately 180° of its circumference and communicate with an axial bore 57 which extends over the full length of the guide 53. The stem is so dimensioned that when it is inserted into the sleeve the plug 54 will contact the seat 48 and a space is defined between the free end of the guide 53 and the bottom of the bore 35. An annular seal 58 is positioned on the shaft 55 against the end of the plug 54 to seal the space between the shaft and the enlarged cylindrical section 49. The conical surface of the plug 54 is loaded against the conical seat 48 by means of a compression spring 59 positioned between seal 58 and another annular seal 61. Seal 61 is retained in place by a split ring 62 received in a peripheral slot in section 49. Secondary metering valve 38 is identical to primary valve 37.

An inclined nozzle fuel-air channel 63 extends from the inner surface of block 17 to intersect air conduit 27. Fuel conduits 64 and 65 extend from adjacent the bottoms of blind bores 35 and 36 to intersect inclined channel 63. Fuel nozzle 16 is connected to block 17 by a short tube 66 which serves as an extension of channel 63 and discharges into an annular manifold 67 (see FIG. 2). Manifold 67 distributes the fuel-air mixture from channel 63 to the aspirator holes 68 which discharge into the air stream passing through the nozzle.

Fuel supplied through conduits 23 and 23' to ports 33 and 34 fills channels 42 and 42'. When the primary metering valve 37 is opened fuel passes through aligned slots 52 and 56 into axial bore 57. The fuel is then discharged into the space at the bottom of blind bore 35 and passes through hole 51 into channel 44 and then through fuel conduit 64 into inclined channel 63 where it is mixed with air from air conduit 27. The resultant fuel-air mixture is then atomized by spraying through the aspirator holes 68 in the nozzle 16. When the secondary metering valve 38 is opened fuel flows through the stem into the blind bore 36 and then through conduit 65 into channel 63.

The metering valves 37 and 38 are controlled by rotation of the valve stems by means of shafts 55 and 55'. In valve 37 rotation of the shaft 55 opens or closes slot 52 by moving slot 56 into or out of alignment therewith. The effective area of the metering orifice is determined by the area of slot 52 exposed through slot 56 and it varies in direct proportion with rotational movement of the valve stem. Similarly, the area of the metering orifice in valve 38 varies directly with rotation of shaft 55' and the associated valve stem.

Figure 4:
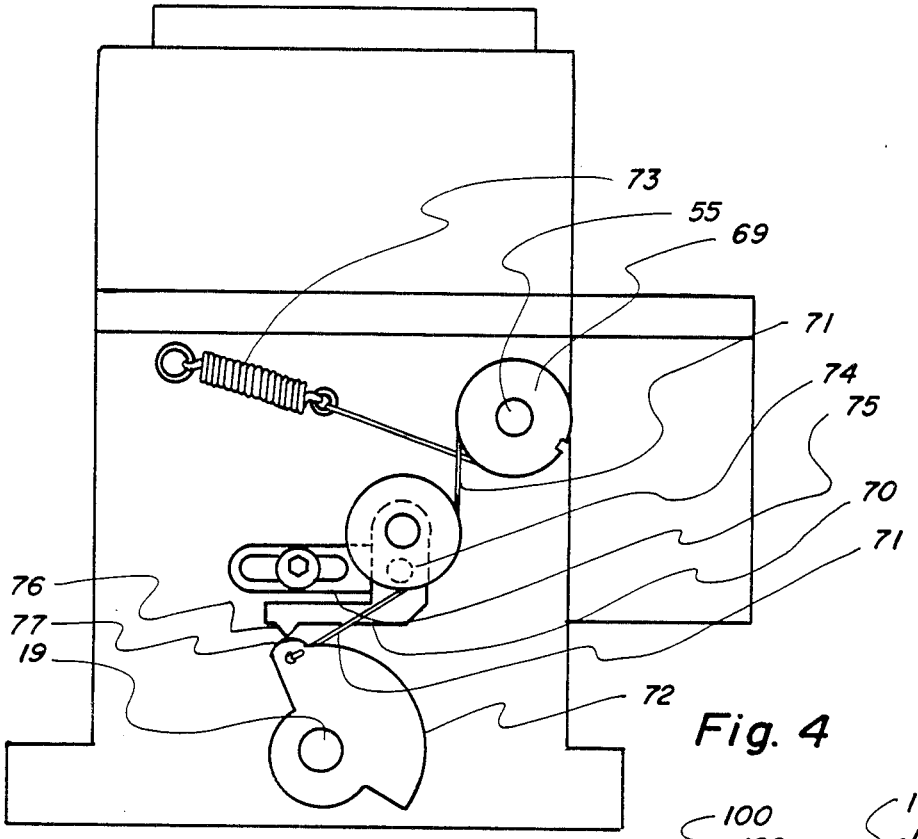
FIG. 4 is a schematic elevation view of the carburetor of FIG. 1.

Movement of the primary metering valve 37 is synchronized with that of the butterfly valve, so that the amount of fuel metered into the nozzle is proportional to the air flow through the carburetor. It has been determined that, except at the extreme upper end of the range, the airflow at a uniform pressure through the butterfly valve is directly proportional to movement of the butterfly, so that the rate of air flow changes uniformly for each degree of movement of the butterfly. As shown in FIGS. 1 and 4, a pulley wheel 69 is connected to the free end of shaft 55 and is driven by a cable 71. One end of cable 71 is secured to the periphery of an arcuate crank 72 which is mounted on one end of shaft 19. The cable encircles the wheel 69 and is anchored at the opposite end to a tension spring 73 secured to the carburetor body. An idler 74 is adjustably mounted on the carburetor body to adjust the position of the cable. The idler 74 is mounted for rotation on one arm of a bell crank 70 which is pivotally supported at the free end of a slotted plate 75. The plate 75 is adjustably clamped to the carburetor by means of a bolt passed through the slot and threaded into the body. The remaining arm of the bell crank forms a pawl or cam follower 76 which is biased against the arcuate surface of the crank 72 by the tension on the cable 71. A protruberance 77 on the surface of the crank forms a cam for pivoting the bell crank 70 in a clockwise direction about its connection to the slotted plate 75, thereby displacing the cable 71 to the right and imparting an initial rotation to the pulley 69 and shaft 55. Shaft 19 is operatively connected to a throttle linkage (not shown) and is rotated in response to movement of the throttle. The cable and pulleys are utilized to achieve a direct drive from the butterfly to the primary metering valve so that movement of the metering valve is synchronized in direct proportion to that of the butterfly and each increment of movement of the butterfly will result in a corresponding uniform increment of movement of the metering valve.

Figure 5:
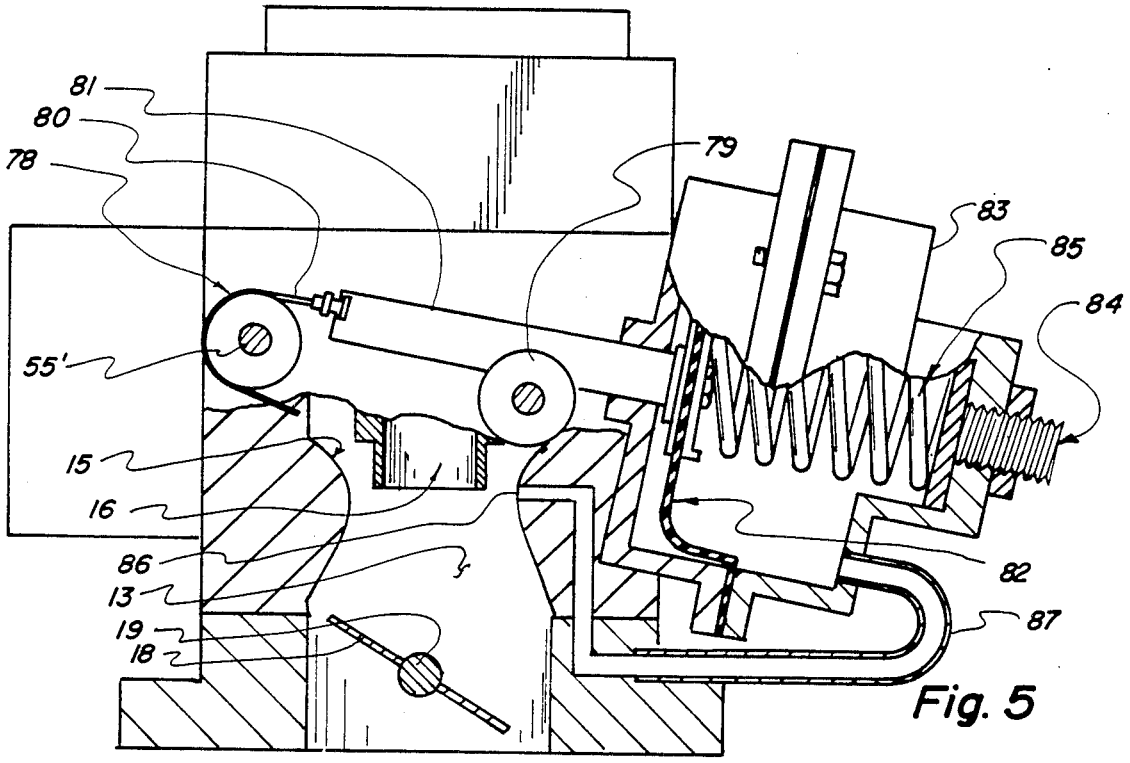
FIG. 5 is an elevation view, partly in section, of the carburetor of FIG. 4 turned 180 degrees.

Movement of the secondary metering valve 38 is coordinated with movement of air through the air passage 13 in the carburetor, so that fuel is metered into the nozzle in accordance with the quantity and weight of the air passing through the carburetor. As shown in FIG. 5, a pulley 78 is secured to the free end of shaft 55' and another pulley 79 is mounted on the carburetor body. A cable 80 is looped around both pulleys and secured to a plunger 81. The plunger is connected to one side of a spring-biased diaphragm 82 which is mounted in a container 83 affixed to the carburetor body. A set screw 84 is provided for adjusting the loading of the spring 85 against the diaphragm. A conduit 86 is formed in the carburetor body with an opening at the throat 15 of the venturi section. The opposite end of the conduit 86 is connected by a tube 87 to the container 83 on the spring-loaded side of the diaphragm. Air flowing through air passage 13 is accelerated in the venturi section with a consequent reduction in pressure. The pressure at the throat 15 is thus lower than the ambient pressure at the exterior of the carburetor. This reduced pressure is communicated through conduit 86 and tube 87 to the interior of the container 83 to form a partial vacuum which acts against the bias force of the spring 85. As the pressure at the throat is reduced the strength of the vacuum is increased until it overcomes the bias force of the spring and draws the diaphragm towards the set screw. Movement of the diaphragm is transmitted through the plunger 81 and cable 80 to rotate the pulley 78 and thus open the metering valve 38. The pressure of air flowing through the venturi section 14 is affected by both the quantity and the density of the air. A given quantity of humid, dense air flowing through the venturi section will produce a lower pressure at the throat 15 than the same quantity of dry, light air. Therefore, the diaphragm is responsive to both the quantity and the density (or weight) of the air flowing through the carburetor. The secondary metering valve 38 will therefore meter fuel in accordance with the quantity of air flowing through air passage 13 and also the atmospheric conditions, such as elevation, temperature and humidity, which affect the density of the air.

With the combination of the primary and secondary metering valves an optimum fuel-to-air ratio can be selected and maintained over the full range of engine operating conditions and at varying atmospheric conditions. The fuel-to-air ratio provided by the primary metering valve can be leaned to the minimum optimum value for no-load conditions with light, dry, hot air. Additional increments of fuel are added by the secondary metering valve for power or load conditions and for variations in air density due to atmospheric conditions. The secondary metering valve can be set to take effect at a predetermined rate of air flow (quantity and density) through the carburetor by adjusting the bias force of spring 85 with the set screw 84. The adjustment of the set screw 84 is coordinated with that of the restrictor screw 30 to prevent overlap between the primary metering valve 37 and the secondary metering valve 38. When the engine is started the primary valve 37 meters an initial burst of fuel to the nozzle 16 as a result of the pivotal movement of the bell crank 70 as the cam follower 76 passes over the cam surface 77. The resultant displacement of the idler 74 rotates the pulley 69 which opens the valve 37 to meter the initial quantity of fuel to start the engine. As the throttle is advanced primary valve 37 is opened in synchronism with butterfly 19 to maintain the desired fuel-to-air ratio during acceleration. When the flow of fuel through conduit 23 reaches the limit determined by the restrictor screw 30 the rate of fuel flow through the primary valve thereafter changes only in response to change of air pressure at the main nozzle venturi section 14. At this point the secondary metering valve 38 is inaugerated to meter additional increments of fuel to the nozzle in accordance with atmospheric conditions and engine load conditions. Operation beyond this point is thereafter sustained by the combined actions of the primary and secondary metering valves to meet the needs of the engine. The present carburetor allows precise control of the fuel-to-air ratio since the secondary metering valve is responsive to the actual density or weight of the air being burned rather than an estimated theoretical weight. The fuel-to-air ratio is calculated in terms of pounds of fuel to pounds of air. Since the optimum fuel-to-air ratio can be maintained the amount of unburned fuel passing through the engine can be substantially reduced with consequent improvement in engine efficiency and reduction in pollutant emission. In road tests conducted over an extended period of time under various atmospheric conditions the present carburetor has increased the engine efficiency of the test vehicles by 30% to 70% and has reduced the level of emissions to legal limits without the use of a catalytic converter or other major pollution control equipment.

Figure 6:
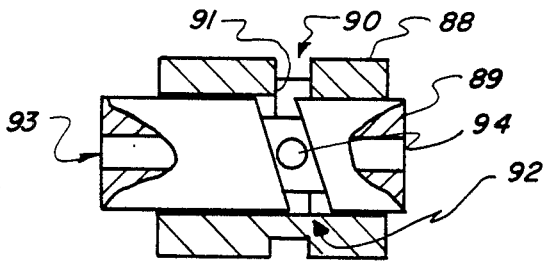
FIG. 6 is an elevation view, partly in section, of an alternate form of metering valve.
Figures 7B, 7C, 7D:
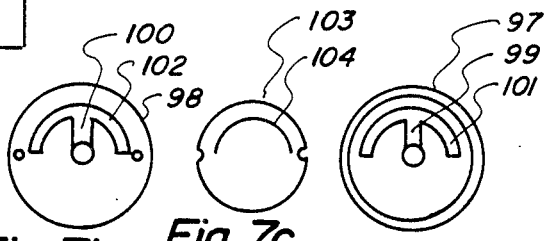
Figure 7A:
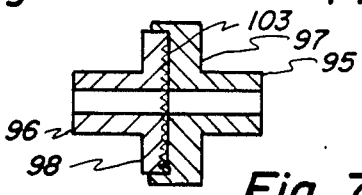

Referring to FIG. 6, an alternate form of metering valve is illustrated as including a sleeve 88 surrounding a cylindrical valve stem 89. A circumferential fuel channel 90 communicates with the interior of the sleeve through a radial hole 91 which is preferably square or rectangular and is aligned with the helix of the metering slot. A metering slot 92 is cut on a helix angle to the longitudinal axis of the stem and extends over approximately 180° of its circumference. The bottom of the metering slot communicates with an axial bore 93 through a radial opening 94. The stem can be rotated within the sleeve to align the metering slot with the hole 91. Fuel supplied to channel 90 then passes through hole 91, slot 92 and opening 94 into axial bore 93. As in the assembly of FIG. 3, the effective area of the metering orifice is determined by the area of the hole 91 exposed through the slot 92.

Another embodiment of a metering valve which is particularly suited for use with motorcycles or similar vehicles is illustrated in FIGS. *7a–d*. The valve includes a tubular section 95 and a stem 96, each of which is provided with a radial flange 97 and 98 at one end. The outer surface of each flange is provided with a radial channel 99 and 100 which communicates with an arcuate channel 101 and 102. A metering disc of wear resistant material 103 is provided with an arcuate slot 104. The disc is held in place on flange 98 by means of small protruberances received in recesses formed in the disc. The stem and tubular section are aligned with the flanges 97 and 98 positioned against each other and the disc 103. Fuel supplied through the tubular section 95 will flow through radial channel 99 into arcuate channel 101 and then through slot 104 into arcuate channel 102, radial channel 100 into the stem 96. The stem is rotatible relative to the tubular section, so that the effective area of the metering orifice is determined by the extent of the channel 101 exposed through the slot 104.

A further embodiment of a metering valve suitable for motorcycles or similar vehicles is illustrated in FIGS. *8a–c*. The valve includes a tubular section 105 provided with a radial flange 106. A fuel passage 107 extends from the tubular section radially to the flat surface of the flange at a point adjacent the periphery thereof. A stem 108 is provided with a flat surface 109 and an alignment pin 110 which is adapted to be received within a central recess 111 in flange 106. The surface 109 is provided with an elongated channel 112 adjacent the periphery. The channel 112 is curved on a spiral and communicates with the exterior of the stem through a series of small radial openings 113. The stem 108 is positioned adjacent the tubular section with the flat surface 109 bearing against the surface of the flange 106. The fuel passage 107 is aligned in overlapping relation with the spiral channel 112 by means of the pin 110 and recess 111. Fuel supplied through the tubular section passes through passage 107 into channel 112 and is sprayed radially of the valve through openings 113. Relative rotation of the tubular section and the stem varies the area of the passage 107 exposed to the channel 112 and thereby meters the rate of fuel flow through the valve. In this valve the openings 113 serve as the atomization apertures, so a separate nozzle is not required. In use the valve can be positioned in the air passage of the carburetor to provide both the metering and atomizing function and to act as an additional venturi assist, being positioned in or near the venturi section.

Referring to FIG. 9 of the drawing a flat slide valve 113 is mounted between two sections of fluid conduit 115 and 116. End caps 117 and 118 are fitted over the adjacent ends of the conduit sections, each cap having a rectangular slot 119, 120 formed therein. A flat stem 121 having a rectangular slot 122 is mounted for sliding movement between the end caps such that at one limit of movement the slot 122 is completely aligned with slots 119 and 120 and at the other limit the slots 119 and 120 are completely covered by the stem. The size of the metering opening or orifice between the conduit sections is thus determined by the position of the sliding stem. It is contemplated that the slide valve 113 may be simplified by omitting one end cap and substituting a solid flat stem for the slotted stem 121. In such case the stem would act as a guillotine to open and close the slot in the remaining end cap. A slide valve such as 113 illustrates in its simplest form the present metering concept in which the area of the metering orifice is varied in direct proportion to movement of the valve stem.

The actuating mechanisms for the primary and secondary fuel metering valves are protected from dirt and oil by sheet metal covers 123 and 124 shown in dotted line in FIG. 1. The covers are secured to opposite sides of the carburetor body 12 and enclose the cable and pulley mechanisms which rotate the primary and secondary valve stems.

While the invention has been described with reference to specifically illustrated preferred embodiments, it should be realized that various changes may be made without departing from the disclosed inventive subject matter particularly pointed out and claimed herebelow.

I claim:

1. A carburetor for an internal combustion engine which includes a source of fuel and combustion chambers, said carburetor including a body surrounding an air passage, a venturi section in said air passage and throttle means for controlling the passage of air through said air passage, said carburetor further comprising a primary fuel circuit having a first metering valve for introducing fuel from the fuel source directly into the air passage to produce a relatively lean fuel-to-air mixture, first operating means for operating the first metering valve in conjunction with said throttle means whereby each incremental movement of the throttle means produces a proportional incremental operation of said first metering valve, a secondary fuel circuit having a second metering valve for introducing additonal fuel from the fuel source directly into the air passage for enriching the fuel-to-air mixture, and second operating means for operating the second metering valve in conjunction with the air pressure in the venturi section in said air passage, said second operating means being adapted to be responsive to the air pressure in said venturi section and to produce a proportional incremental operation of said second metering valve in response to incremental changes in the air pressure in said venturi section.

2. A carburetor as defined in claim 1 wherein said second operating means comprises a movable means operatively connected to the second metering valve, with said moveable means being responsive to a decrease in air pressure in the venturi section for moving in a first direction to open the second metering valve, and responsive to an increase in air pressure in the venturi section for moving in a second direction to close the second metering valve.

3. A carburetor as defined in claim 2 wherein the first and second metering valves each include a metering orifice and a valve stem, with the area of each orifice being directly proportional to movement of the valve stem.

4. A carburetor as defined in claim 3 in which the air passage is provided with a restricted throat section, and the carburetor further includes a nozzle mounted in the air passage adjacent the throat section, and the throttle means comprises an air flow control means which includes a butterfly valve positioned below the throat section.

5. A carburetor as defined in claim 4 wherein a direct drive connects the butterfy valve and the first metering valve of the primary fuel circuit such that when the butterfly is opened each increment of movement thereof produces a corresponding incremental operation of the first metering valve.

6. A carburetor as defined in claim 5 wherein the movable means includes a spring biased diaphragm drivingly connected to the second metering valve of the secondary fuel circuit, and a conduit is provided to connect the restricted throat to the diaphragm in opposition to the spring bias.

7. For use with an internal combustion engine a carburetor which includes a throttle control means, a body surrounding an air passage, a venturi section in said air passage and a fuel metering assembly mounted on the body, said assembly including: an idle fuel circuit having a fuel metering valve and a fuel-air mixture metering valve connected in series for introducing fuel directly into the air passage; a primary fuel circuit having a metering valve which is controlled by the throttle control means for introducing fuel directly into the air passage; and a secondary fuel circuit having a metering valve which is controlled by pressure within the venturi section for introducing fuel directly into the air passage.

* * * * *